US007004267B1

(12) United States Patent
Pace

(10) Patent No.: US 7,004,267 B1
(45) Date of Patent: Feb. 28, 2006

(54) DRILL BIT CONE PROTECTOR

(76) Inventor: Raymond W. Pace, P.O. Box 126, Willow, OK (US) 73673

( * ) Notice: Subject to any disclaimer, the term of this patent is extended or adjusted under 35 U.S.C. 154(b) by 0 days.

(21) Appl. No.: 10/822,262

(22) Filed: Apr. 12, 2004

(51) Int. Cl.
*E21B 10/00* (2006.01)

(52) U.S. Cl. ..... 175/331; 175/374

(58) Field of Classification Search ..... 175/331, 175/374
See application file for complete search history.

(56) References Cited

U.S. PATENT DOCUMENTS

| | | | | |
|---|---|---|---|---|
| 2,740,612 | A * | 4/1956 | Phipps | 175/393 |
| 3,788,407 | A * | 1/1974 | Lorenz et al. | 175/307 |
| 4,013,325 | A | 3/1977 | Rear | |
| 4,304,311 | A | 12/1981 | Shinn | |
| 4,545,441 | A | 10/1985 | Williamson | |
| 4,560,013 | A | 12/1985 | Beimgraben | |
| 4,682,663 | A | 7/1987 | Daly et al. | |
| 5,667,027 | A | 9/1997 | Poffenroth | |
| 5,697,461 | A * | 12/1997 | Newton et al. | 175/331 |
| 6,173,797 | B1 * | 1/2001 | Dykstra et al. | 175/374 |
| 6,234,261 | B1 * | 5/2001 | Evans et al. | 175/374 |
| 2003/0192721 | A1 * | 10/2003 | Singh et al. | 175/341 |

* cited by examiner

*Primary Examiner*—William Neuder

(57) ABSTRACT

A drill bit for use in earth-boring operations includes a threaded upper section removably connectable to a power source, and a shank section connected thereto and having a centrally disposed longitudinal axis. The shank section further has a lower portion extending substantially vertically and parallel to the axis and a plurality of notches spaced along a perimeter thereof. The present invention further includes a plurality of carbide buttons affixed to the plurality of notches respectively for cooperating with a plurality of cones during operating conditions to thereby prevent the plurality of cones from dislodging from the lower section and for assisting an operator to bore a substantially uniform hole in a predetermined direction and about the longitudinal axis.

12 Claims, 4 Drawing Sheets

DRILL BIT CONE PROTECTOR

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a drill bit and, more particularly, to a drill bit cone protector for preventing drilling cones from becoming dislodged during operating conditions and for improving earth-boring operations.

2. Prior Art

In rotary reaming, the bit is fixed on the end of a rotating drill pipe inside a casing, the drill pipe being lowered as the reaming progresses. A heavy artificial substance known as drilling mud is circulated down through the drill pipe, out through the bit and back up the casing to remove rock fragments. The drilling mud cools the bit, washes the cutting elements so they present a clean cutting face where the cutting takes place and, as indicated, lifts or carries debris resulting from the reaming to the surface.

A common problem has been the retention of the cutter pre-form elements which must be secured to the crown of the bit in an extremely rigid manner. The breakage of any such elements increases the cutting load of the next following cutting element in the set which is then more likely to break or be subjected to greater wear and abuse. These problems tend to reduce the average lifetime of the drill bit, which is reflected in decreased efficiency and higher costs for the reaming operations.

Accordingly, a need remains for a drill bit cone protector to overcome the above-noted shortcomings and to improve earth-boring operations.

BRIEF SUMMARY OF THE INVENTION

In view of the foregoing background, it is therefore an object of the present invention to provide a drill bit cone protector. These and other objects, features, and advantages of the invention are provided by a drill bit cone protector for use in earth-boring operations that includes a threaded upper section removably connectable to a power source for causing the drill bit to rotate in a select direction.

The present invention further includes a shank section that has a centrally disposed longitudinal axis and a top end secured to the upper section. The shank section preferably has a generally rectangular shape for protecting a plurality of cones during operating conditions and for creating a substantially symmetrical hole in a ground surface.

The shank section further has an outer surface defining a plurality of blades (or shoulders) and extending outwardly and downwardly from the upper section. The outer surface has a lower portion extending substantially vertically and parallel to the axis and has a plurality of notches spaced along a perimeter of the shank section. The shank section preferably has a diameter substantially equal to a diameter of the lower section, described hereinbelow.

The lower section includes a plurality of cones. Each cone has an axis of rotation radially offset from the longitudinal axis and distributed substantially symmetrically thereabout. The plurality of cones have a perimeter extending outwardly to the lower portion of the shank section.

A plurality of carbide buttons are affixed to the plurality of notches respectively for cooperating with the plurality of blades during operating conditions to thereby prevent the plurality of cones from dislodging from the lower section. The plurality of carbide buttons further cooperate with the plurality of blades for assisting an operator to bore a substantially uniform hole in a predetermined direction and about the longitudinal axis. The plurality of carbide buttons are preferably arranged so that the shank section will maintain a substantially smooth outer surface.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
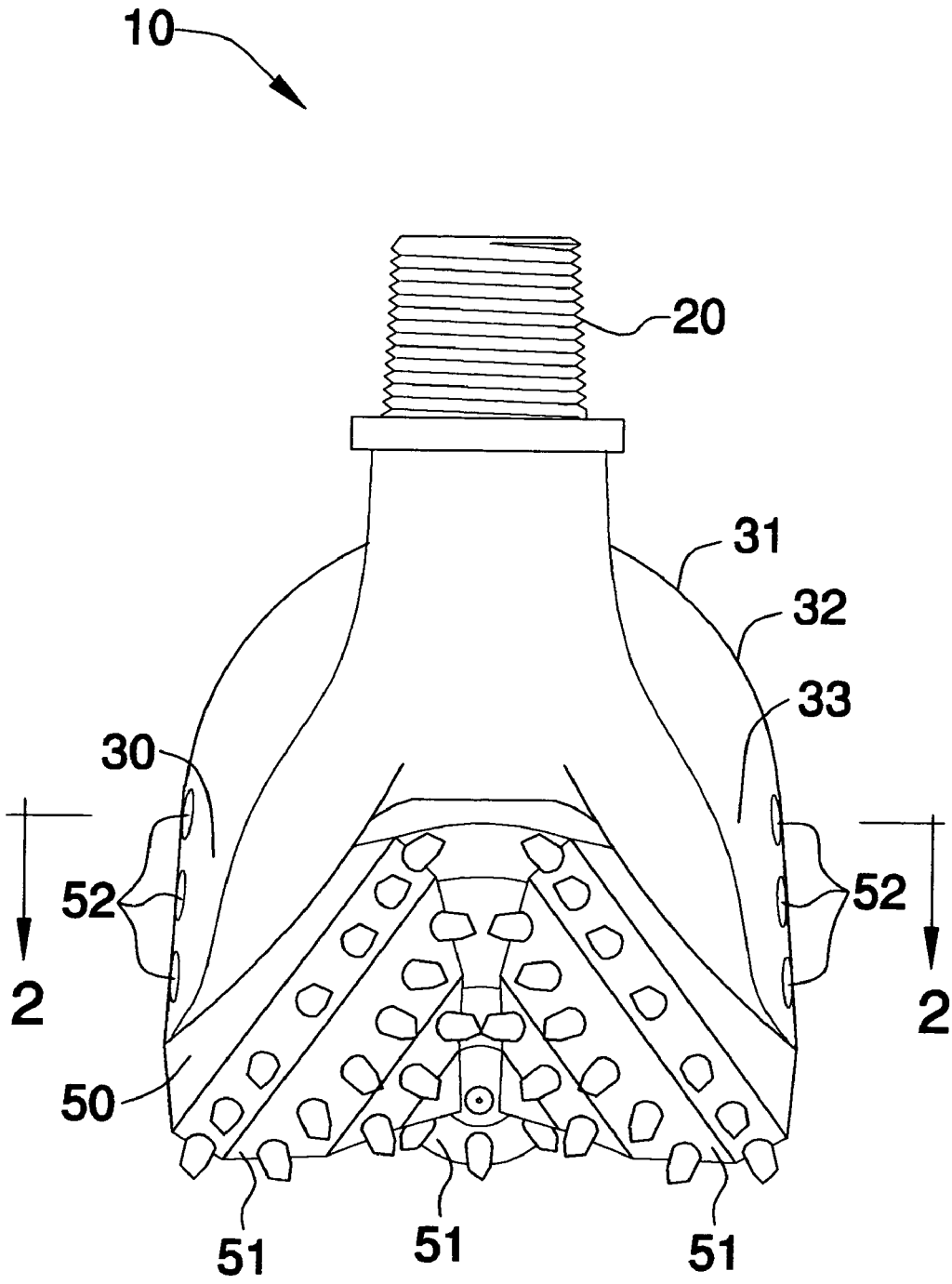
FIG. 1 is a side elevational view showing a drill bit cone protector, in accordance with the present invention.
Figure 2:
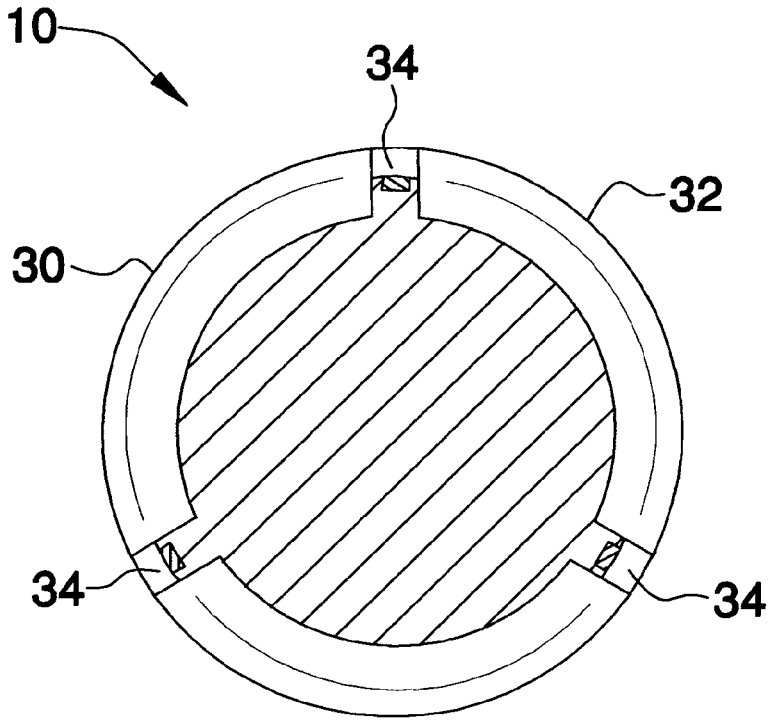
FIG. 2 is a cross-sectional view of the apparatus shown in FIG. 1, taken along line 2—2.
Figure 3:
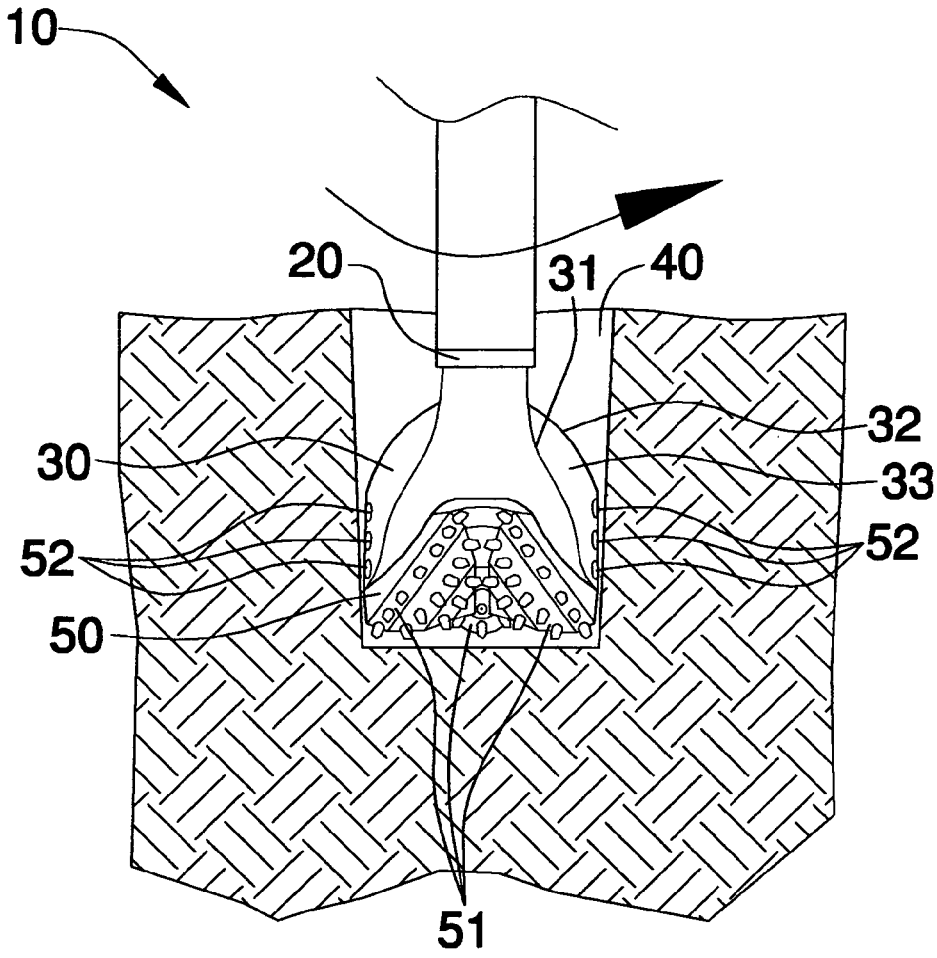
FIG. 3 is a side elevational view of the apparatus shown in FIG. 1 wherein the plurality of carbide buttons help prevent the plurality of cones from being dislodged from the shaft section.
Figure 4:
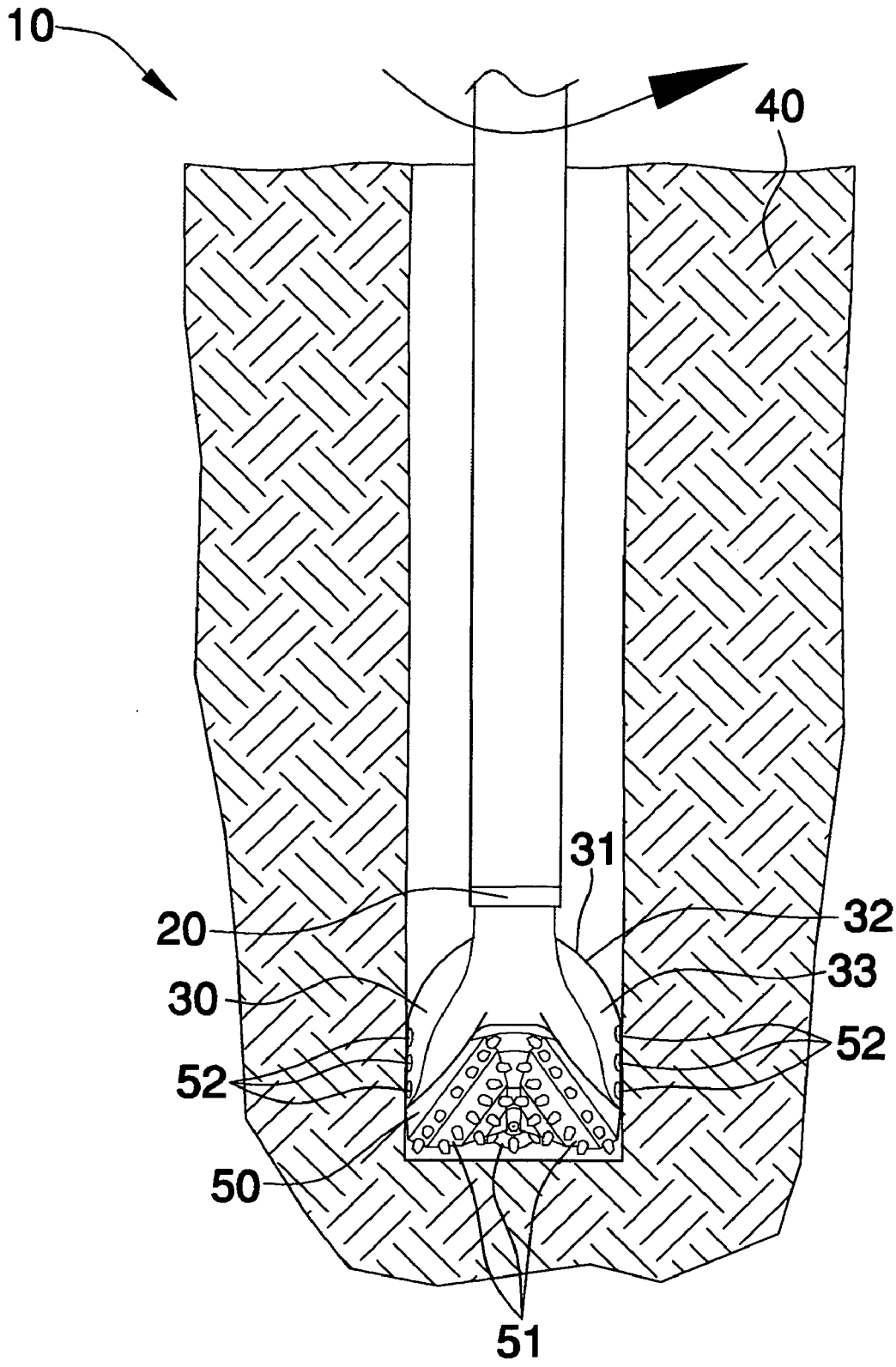
FIG. 4 is a side elevational view of the apparatus shown in FIG. 1 wherein the plurality of carbide buttons cooperate with the plurality of cones during reaming operations.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide a drill bit cone protector. It should be understood that the apparatus 10 may be employed in many different earth-boring operations. Furthermore, it should be understood that the plurality of carbide buttons do not contribute to reaming. Rather, such carbide buttons assist the plurality of cones from becoming dislodged from the lower section of the shank so that the drill bit can bore a substantially uniform hole and extend the life of the plurality of cones.

Referring initially to FIG. 1, the drill bit 10 includes a threaded upper section 20 removably connectable to a power source (not shown) for causing the drill bit 10 to rotate in a select direction. The present invention further includes a shank section 30 that has a centrally disposed longitudinal axis and a top end 31 secured to the upper section 20. The shank section 30 preferably has a generally rectangular shape for protecting the plurality of cones 51 and for creating a substantially symmetrical hole in a ground surface 40.

The shank section 30 further has an outer surface 32 for defining a plurality of blades (or shoulders) extending outwardly and downwardly from the upper section 20. The outer surface 32 has a lower portion 33 extending substantially vertically and parallel to the axis and has a plurality of notches 34 spaced along a perimeter of the shank section 30. The shank section 30 preferably has a diameter substantially equal to a diameter of the lower section 50, described hereinbelow, so that external forces impacting the plurality of cones can be reduced.

The lower section 50 includes a plurality of cones 51. Each cone 51 has an axis of rotation radially offset from the longitudinal axis and distributed substantially symmetrically thereabout. The plurality of cones 51 have a perimeter extending outwardly to the lower portion 33 of the shank section 30.

A plurality of carbide buttons 52 are affixed to the plurality of notches 34 respectively for cooperating with the plurality of blades during operating conditions to thereby prevent the plurality of cones 51 from breaking off the lower section. The plurality of carbide buttons 52 further cooperate with the plurality of blades for assisting an operator to bore a substantially uniform hole in a predetermined direction and about the longitudinal axis. Advantageously, the plurality of cones 51 will not be damaged and worn down as quickly as conventional drills. Also, earth-boring operations will become streamlined by eliminating any time needed to re-ream the hole after the initial reaming. Reducing work time will improve working efficiency and reduce work cost.

Of course, the plurality of carbide buttons 52 may are arranged so that the shank section will maintain a substantially smooth outer surface. Such carbide buttons 52 are spaced substantially equidistant from each other. This composition and arrangement of the carbide buttons 52 will make the drill bit 10 more efficient and extend the life of the drill bit 10.

The appealing features of the drill bit 10 are the modified drill bit shank section 30 or blade (shoulders). Advantageously, the shank section 30 has been modified from a conventional triangular configuration to a rectangular configuration incorporated with carbide buttons 52 along the perimeter edges thereof.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A drill bit for use in earth-boring operations and comprising:

a threaded upper section removably connectable to a power source for causing said drill bit to rotate in a select direction;

a shank section having a centrally disposed longitudinal axis and further having a top end secured to said upper section, said shank section further having an outer surface for defining a plurality of blades extending outwardly and downwardly from said upper section, said outer surface having a lower portion extending substantially vertically and parallel to the axis, said outer surface having a plurality of notches spaced along a perimeter of said shank section;

a lower section comprising a plurality of cones each having an axis of rotation radially offset from the longitudinal axis and distributed substantially symmetrically thereabout, said plurality of cones having a perimeter extending outwardly to said lower portion of said shank section; and a plurality of carbide buttons affixed to said plurality of notches respectively and for cooperating with said plurality of blades during operating conditions to thereby prevent said plurality of cones from dislodging from said lower section, said plurality of carbide buttons further cooperating with said plurality of blades for assisting an operator to bore a substantially uniform hole in a predetermined direction and about the longitudinal axis.

2. The drill bit of claim 1, wherein said shank section has a generally rectangular shape.

3. The drill bit of claim 1, wherein said plurality of carbide buttons are embedded in the plurality of notches respectively so that said shank section will maintain a substantially smooth outer surface.

4. The drill bit of claim 1, wherein said plurality of carbide buttons are spaced substantially equidistant from each other.

5. The drill bit of claim 1, wherein said shank section has a diameter substantially equal to a diameter of said lower section.

6. A drill bit for use in earth-boring operations and comprising:

a threaded upper section removably connectable to a power source for causing said drill bit to rotate in a select direction;

a generally rectangular shank section having a centrally disposed longitudinal axis and further having a top end secured to said upper section, said shank section further having an outer surface for defining a plurality of blades extending outwardly and downwardly from said upper section, said outer surface having a lower portion extending substantially vertically and parallel to the axis, said outer surface having a plurality of notches spaced along a perimeter of said shank section;

a lower section comprising a plurality of cones each having an axis of rotation radially offset from the longitudinal axis and distributed substantially symmetrically thereabout, said plurality of cones having a perimeter extending outwardly to said lower portion of said shank section; and a plurality of carbide buttons affixed to said plurality of notches respectively and for cooperating with said plurality of blades during operating conditions to thereby prevent said plurality of cones from dislodging from said lower section, said plurality of carbide buttons further cooperating with said plurality of blades for assisting an operator to bore a substantially uniform hole in a predetermined direction and about the longitudinal axis.

7. The drill bit of claim 6, wherein said plurality of carbide buttons are arranged with the plurality of notches respectively so that said shank section will maintain a substantially smooth outer surface.

8. The drill bit of claim 6, wherein said plurality of carbide buttons are spaced substantially equidistant from each other.

9. The drill bit of claim 6, wherein said shank section has a diameter substantially equal to a diameter of said lower section.

10. A drill bit for use in earth-boring operations and comprising:

a threaded upper section removably connectable to a power source for causing said drill bit to rotate in a select direction;

a generally rectangular shank section having a centrally disposed longitudinal axis and further having a top end secured to said upper section, said shank section further having an outer surface for defining a plurality of blades extending outwardly and downwardly from said upper section, said outer surface having a lower portion extending substantially vertically and parallel to the axis, said outer surface having a plurality of notches spaced along a perimeter of said shank section;

a lower section comprising a plurality of cones each having an axis of rotation radially offset from the longitudinal axis and distributed substantially symmetrically thereabout, said plurality of cones having a perimeter extending outwardly to said lower portion of said shank section; and a plurality of carbide buttons arranged within the plurality of notches so that said shank section will maintain a substantially smooth outer surface and for cooperating with said plurality of blades during operating conditions to thereby prevent said plurality of cones from dislodging from said lower section, said plurality of carbide buttons further cooperating with said plurality of blades for assisting an operator to bore a substantially uniform hole in a predetermined direction and about the longitudinal axis.

11. The drill bit of claim 10, wherein said plurality of carbide buttons are spaced substantially equidistant from each other.

12. The drill bit of claim 10, wherein said shank section has a diameter substantially equal to a diameter of said lower section.

* * * * *